US007591773B2

(12) United States Patent
Weir et al.

(10) Patent No.: US 7,591,773 B2
(45) **Date of Patent: *Sep. 22, 2009**

(54) ABDOMINAL MUSCLE TRAINING APPARATUS

(75) Inventors: Ross John Weir, Loughborough (GB); Michael Peter Caine, Cropston (GB)

(73) Assignee: Progressive Sports Technologies Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/652,440

(22) Filed: Jan. 11, 2007

(65) Prior Publication Data

US 2007/0184949 A1 Aug. 9, 2007

(30) Foreign Application Priority Data

Aug. 31, 2005 (GB) ..... 0517691.2
Aug. 30, 2006 (WO) ..... PCT/GB2006/050263

(51) Int. Cl.
*A63B 26/00* (2006.01)

(52) U.S. Cl. ..... 482/140; 297/423.11; 297/195.11; 482/129; 482/130; 482/72

(58) Field of Classification Search ..... 482/123, 482/129, 121, 140, 142, 130, 72; 280/32.5; 297/423.11, 16, 195.11
See application file for complete search history.

(56) References Cited

U.S. PATENT DOCUMENTS 3,669,493 A * 6/1972 Vowles ..... 297/423.11
4,249,774 A * 2/1981 Andreasson ..... 297/311
D265,612 S * 8/1982 Gusrud et al. ..... D6/373
4,390,076 A * 6/1983 Wier et al. ..... 180/11
4,534,590 A * 8/1985 Yamamura et al. ..... 297/180.12
4,552,404 A * 11/1985 Congleton ..... 297/330
4,589,699 A * 5/1986 Dungan ..... 297/423.12
D286,822 S * 11/1986 Opsvik ..... D6/335
D291,155 S * 8/1987 Wertheimer ..... D6/335
4,743,010 A * 5/1988 Geraci ..... 482/72
D299,594 S * 1/1989 Richardson ..... D6/335
4,809,804 A * 3/1989 Houston et al. ..... 180/65.51
4,913,487 A * 4/1990 Breckel et al. ..... 297/14
5,054,852 A * 10/1991 Tholkes ..... 297/172
5,306,218 A * 4/1994 Huang Chen ..... 482/72
D348,568 S * 7/1994 Landry ..... D6/330
5,356,358 A * 10/1994 Chen ..... 482/96
5,401,078 A * 3/1995 Riach ..... 297/423.11

(Continued)

*Primary Examiner*—Lori Amerson
(74) *Attorney, Agent, or Firm*—Renner, Kenner, Greive, Bobak, Taylor & Weber

(57) ABSTRACT

Exercise apparatus (10) for training the abdominal muscles of a user (41) comprises a lever frame (11) linked to a support frame (12) at a pivot (13). The lever frame (11) has first and second arms (14, 15) joined at a central junction (16) which also forms a fulcrum for the lever frame (11). The support frame (12) consists of a base member (19) having a seat portion (21) associated therewith. The apparatus (10) is adapted to support a user (41) in a half-kneeling position so as to promote neutral pelvic alignment during the performance of abdominal muscle training exercise. In use, the exercise apparatus (10) is operated by the user (41) pushing the first arm (14) away from his or her body so as to cause the lever frame (11) to rotate about its fulcrum (16). This lifts the second arm (15), which in turn causes the seat portion (21) associated with the base member (19) to lift and/or tilt. The user's abdominal muscles are thus exercised in lifting his or her own body mass.

17 Claims, 6 Drawing Sheets

U.S. PATENT DOCUMENTS 5,458,553 A * 10/1995 Wu ..... 482/95
5,545,177 A * 8/1996 Coseo ..... 606/204
D398,669 S * 9/1998 Anderson et al. ..... D21/662
5,857,747 A * 1/1999 Mundkowski ..... 297/423.11
5,884,935 A * 3/1999 Tholkes ..... 280/657
5,971,485 A * 10/1999 Clark ..... 297/423.12
D425,321 S * 5/2000 Tholkes et al. ..... D6/338
6,065,808 A * 5/2000 Tinsley ..... 297/423.11
6,123,392 A * 9/2000 Alfred et al. ..... 297/466
6,349,993 B1 * 2/2002 Walsh ..... 297/466
6,440,046 B1 * 8/2002 Tholkes ..... 482/142
6,543,853 B1 * 4/2003 Splane, Jr. ..... 297/423.12
6,698,831 B2 * 3/2004 Lloyd ..... 297/195.11
6,729,690 B2 * 5/2004 Roleder et al. ..... 297/423.12
6,923,749 B1 * 8/2005 Smith ..... 482/72
7,115,081 B2 * 10/2006 Stearns ..... 482/140
7,144,080 B2 * 12/2006 Lloyd ..... 297/195.11
D555,249 S * 11/2007 Roleder et al. ..... D24/184
D555,794 S * 11/2007 Roleder et al. ..... D24/184
7,367,623 B2 * 5/2008 Tholkes et al. ..... 297/300.8
7,488,281 B2 * 2/2009 Weir et al. ..... 482/140
2002/0067060 A1 * 6/2002 Lloyd ..... 297/195.11
2002/0101108 A1 * 8/2002 Roleder et al. ..... 297/423.12
2002/0171281 A1 * 11/2002 Cochran ..... 297/423.11
2003/0090131 A1 * 5/2003 Roleder et al. ..... 297/195.11
2004/0070253 A1 * 4/2004 Murphy et al. ..... 297/423.11
2005/0035644 A1 * 2/2005 Lloyd ..... 297/423.11
2006/0100070 A1 * 5/2006 Abdo ..... 482/121
2006/0252613 A1 * 11/2006 Barnes et al. ..... 482/95
2007/0021280 A1 * 1/2007 Tyree ..... 482/94
2008/0096743 A1 * 4/2008 Weir et al. ..... 482/140

* cited by examiner

ABDOMINAL MUSCLE TRAINING APPARATUS

FIELD OF THE INVENTION

This invention relates to exercise apparatus for training a user's abdominal muscles. In particular, it relates to such apparatus in which the user exercises in a supported half-kneeling position, promoting neutral pelvic alignment.

BACKGROUND OF THE INVENTION

During the performance of physical exercise, the body is subjected to stresses and strains beyond that which would normally be encountered in most people's everyday activities. These stresses and strains increase the risk of injury occurring to vulnerable areas of the body such as the joints, and care should be taken to minimise such risks wherever possible during training.

In the performance of exercises for training the abdominal muscles, with which the present invention is concerned, the joint between the pelvis and the spine is particularly at risk. To minimise the risk of injury to this joint, it is thought to be beneficial to maintain the pelvis, so far as is possible during the performance of the exercise, in a position substantially at the mid-point of its range of anterior to posterior rotation about the joint. This position is referred to herein as neutral pelvic alignment.

Fitness equipment for training a user's abdominal muscles generally operates with the user in a supine body position. However, for users lacking mobility, such as those who are disabled, obese or elderly, it can be difficult comfortably to adopt the supine position, and even more difficult to return to a standing position afterwards. As a result, those users who are likely to benefit most from abdominal muscle training can find themselves excluded from performing such exercise.

In an attempt to overcome this problem, some abdominal exercise devices have been provided which offer the user the option of exercising from a seated position. However, such devices do not promote neutral pelvic alignment, leaving the user at an increased risk of injury.

The ideal body position for maintaining neutral pelvic alignment is referred to herein as the half-kneeling position. This involves the buttocks and knees only being supported, with a somewhat larger angle being formed between the abdomen and the upper legs than is customary in a normal seated position. Static seats, known as kneel chairs, which support a user in the half-kneeling position are well known and are widely used by those suffering from back trauma, as an aid to rehabilitation. However it is believed that, until now, no exercise apparatus has sought to support a user in the half-kneeling position for the performance of abdominal muscle training exercise. Furthermore, current designs of kneel chairs do not promote easy and safe mounting and dismounting of the seat, requiring the user to mount the seat from the front of the chair and to step back into the seat.

In addition to the above discussed concerns regarding neutral pelvic alignment, many known abdominal training devices suffer further shortcomings in that they rely solely on weight-stacks or elastic resistance elements to provide the resistive force which the user must overcome during exercise. The use of weight-stacks inevitably greatly increases the overall mass of the product, making it difficult and expensive to ship, and cumbersome to move once installed. A drawback involved in the use of elastic resistance elements alone is that the resistive load increases exponentially as the material is stretched. Unless used in combination with other resistive loads, this provides an unnatural load and decreases the specificity of the exercise, i.e. the targeting of a particular exercise to a particular group of muscles.

SUMMARY OF THE INVENTION

The present invention seeks to address these problems by enabling a user to perform abdominal muscle training exercise from a half-kneeling position, thus promoting neutral pelvic alignment, with the resistive load being provided primarily by the user's own body mass. The present invention further seeks to provide exercise apparatus capable of being adapted for use as a static kneel chair, in which the user may easily and safely mount and dismount from the rear of the seat.

According to the present invention there is provided exercise apparatus comprising:

- a support frame having a base member and a seat portion associated therewith, adapted to support a user in a half-kneeling position; and
- a lever frame having a first arm adapted for manual operation by said user, and a second arm linked to the base member, said first and second arms being joined at a junction at or adjacent a fulcrum for the lever frame;

whereby in use, the exercise apparatus is operable by said user manually pushing said first arm away from his or her body thereby to rotate the lever frame about its fulcrum, thus lifting said second arm, which in turn causes the seat portion associated with the base member to lift and/or tilt, the user's abdominal muscles thereby being exercised in lifting the user's own body mass.

In a currently preferred embodiment of the present invention, the first and second arms of the lever frame are arranged generally perpendicular to one another thereby to form a generally L-shaped lever frame. The lever frame thus has a handle end, adapted for manual operation, and a free end, with the junction being located therebetween. The junction between the first and second arms is preferably rounded and arranged to bear against a working surface beneath the exercise apparatus. The rounded junction may be arranged to bear directly against the working surface, or in alternative embodiments of the present invention may be arranged to bear against the working surface via an intermediary member. Suitable constructions of intermediary member include the use of a rocker bar arranged perpendicularly across the lever frame and having rounded feet at either end thereof adapted to bear against the working surface. The forces imparted by the user during exercise are thus displaced to either side of the apparatus, giving enhanced stability.

The exercise apparatus is operated by the user repeating a cycle of pushing the first arm away from his or her body, and subsequently releasing the manual force applied to the first arm. As the manual force is released, the user's body mass urges the seat portion back to its initial rest position, which in turn causes the lever frame to return to its rest position. The lever frame thus rotates about the fulcrum in a back-and-forth rocking motion as the manual force is repeatedly applied and released. To provide comfort to the user, and to enable the performance of a range of different exercises, the first arm preferably comprises a handlebar adapted for manual operation by the user.

The second arm of the lever frame is preferably linked to the support frame base member via a pivot. Operation of the lever frame causes the second arm and the pivot to lift away from the working surface, causing the seat portion both to lift and to tilt. This action ensures that both the user's upper and lower abdominal muscles are exercised in lifting his or her body mass, thus promoting the execution of a correct abdominal contraction. Counter-clockwise rotation of the lever frame about the fulcrum causes clockwise rotation of the support frame about the pivot, and vice versa.

The support frame base member extends from the pivot to a foot adapted to bear against the working surface beneath the exercise apparatus. The foot remains in contact with the working surface throughout the performance of exercise, and is adapted for translational movement along the working surface towards the lever frame fulcrum, when the pivot is lifted away from the working surface by the action of the lever frame. The foot therefore effectively acts as a further fulcrum for the support frame.

To facilitate the translational movement of the foot along the working surface, the foot is preferably provided with a rotational member. Most preferably, the rotational member comprises one or more wheel(s) or roller(s).

In a currently preferred construction of exercise apparatus according to the present invention, the base member extends beyond the pivot, distal from the foot. The seat portion is then joined to the base member at a connection point located distal from the foot, such that the pivot is located between said foot and said connection point.

In this embodiment, the seat portion is joined to the base member at an acutely angled junction, thereby forming a generally V-shaped support frame. This shape enables the seat portion to be correctly aligned for supporting a user in the half-kneeling position, and also facilitates the interaction between the lever frame and the support frame, as the generally L-shaped lever frame and the generally V-shaped support frame can be arranged such that the respective junctions of said frames are generally co-incident when the apparatus is at rest. To impart further strength to the support frame structure, the seat portion may be further supported by one or more struts extending from the base member at or adjacent the foot.

Modifications may be made to the exercise apparatus to allow the user to perform work against an applied resistive load in addition to the work done in lifting his or her own body mass. For example, one or more additional mass element(s) may be suspended between the respective junctions of the generally L-shaped lever frame and the generally V-shaped support frame. Alternatively, or additionally, the respective junctions of the generally L-shaped lever frame and the generally V-shaped support frame may additionally be linked by an elastic resistance element.

Elastic resistance elements may instead be utilised to link the free end of the lever frame with the foot end of the support frame. In such embodiments, the foot end of the support frame is preferably provided with one or more fixing points, whilst the elastic resistance elements are preferably adapted to extend from the free end of the lever frame and are provided with complementary engagement means to connect to said fixing points.

In order to support the user in the half-kneeling position, and thereby promote neutral pelvic alignment, the seat portion comprises a buttock support element and a knee rest element. The knee rest element may be formed either as a single unit extending across the support frame and adapted to accommodate both knees, or alternatively may take the form of two separate units, displaced slightly to the sides of the support frame, each adapted to accommodate one knee.

In a currently preferred embodiment of exercise apparatus according to the present invention, two separate knee rest elements are provided, each being mounted independently of the other via a flexible mount. The flexible mount permits minimal movement of each knee rest element relative to the support frame, thereby to accommodate leg movement during exercise without causing undue stress to the user's knees.

The pivot between the lever frame and the support frame preferably comprises a lockable pin engageable with a complementary aperture formed in each of the second arm of the lever frame and the base member of the support frame. Most preferably, the second arm of the lever frame and the base member of the support frame each comprise a plurality of spaced like apertures, to enable the location of the pivot to be adjusted. The resistance provided by the user's body mass, and hence the work required to overcome that resistance, can thus be adjusted by changing the location of the pivot.

The construction of exercise apparatus according to the present invention is not limited to any particular form, however it is preferred that at least one of the lever frame and the support frame are formed with a parallel tubular construction, whilst in certain embodiments each said frame is formed with a parallel tubular construction. In such embodiments, the lever frame thus comprises a pair of parallel tubular members cross-linked at the handlebar and/or at or adjacent the pivot, whilst the support frame comprises a pair of parallel tubular members cross-linked at the seat portion and/or at or adjacent the foot. In embodiments where the use of elastic resistance elements linking the foot end of the support frame with the free end of the lever frame is combined with the tubular construction of the lever frame, the elastic resistance elements may conveniently be recoiled within the tubular lever frame for storage when not in use.

The support frame is preferably detachable from the lever frame thereby to form a static kneel chair. One or both of the thus-disassembled frames is preferably further foldable to facilitate storage of said exercise apparatus when not in use.

BRIEF DESCRIPTION OF THE SEVERAL VIEWS OF THE DRAWINGS

In order that the present invention may be fully understood, preferred embodiments thereof will now be described in detail, though only by way of example, with reference to the accompanying drawings in which.

DETAILED DESCRIPTION OF THE INVENTION

Figure 1:
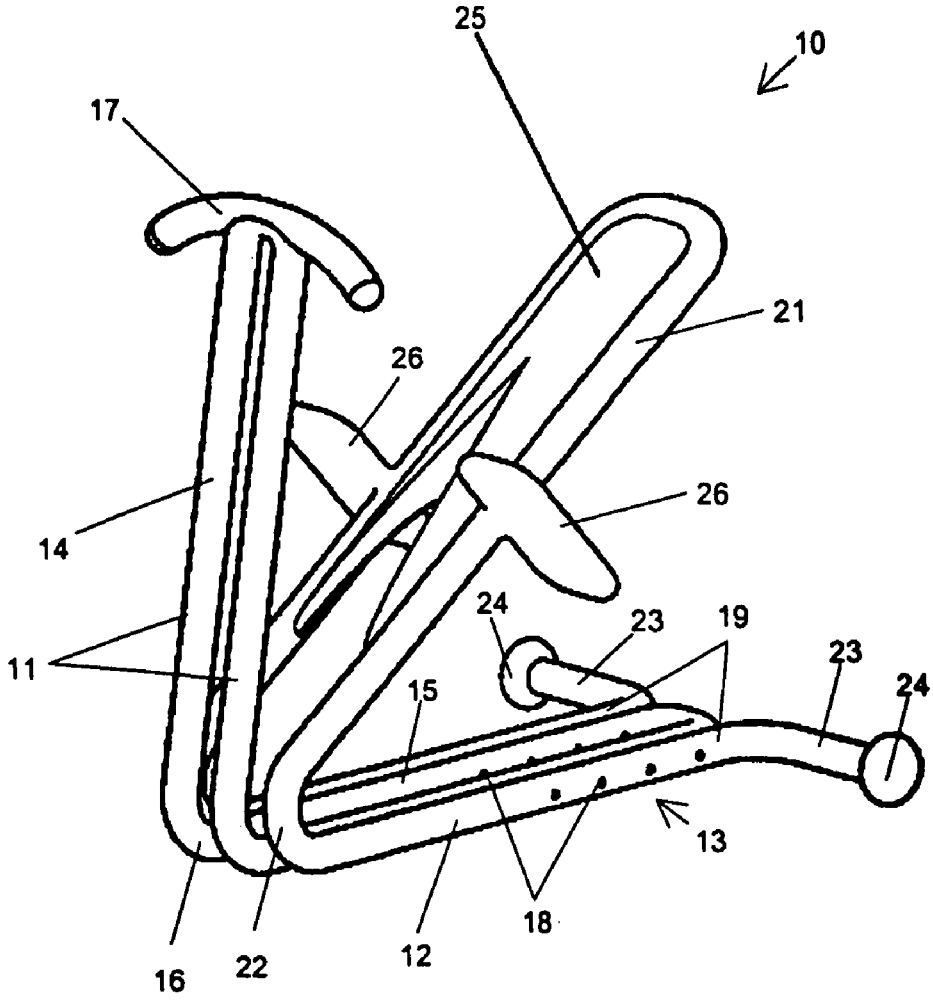
FIG. 1 is a perspective view of exercise apparatus according to a first embodiment of the present invention.

Referring first to FIG. 1, there is shown a first embodiment of exercise apparatus, generally indicated 10, according to the present invention. The exercise apparatus 10 comprises a lever frame 11 and a support frame 12 linked via a pivot, generally indicated 13, as will be discussed in more detail below.

The lever frame 11 is generally L-shaped, having first and second arms 14, 15 joined at a rounded central junction 16 which forms a fulcrum for the lever frame 11. The first arm 14 terminates at a handlebar 17, whilst the second arm 15 is provided with a plurality of spaced apertures 18 for receiving a pivot pin (not shown) as will be discussed in more detail below.

The support frame 12 is generally V-shaped, having a base member 19 with a seat portion 21 joined thereto at a rounded central junction 22. The base member 19 is provided with a plurality of further spaced apertures 18, and terminates in a foot 23 which is provided with a pair of wheels 24, one at each side of the support frame 12. The seat portion 21 comprises a buttock rest element 25 and a pair of knee rest elements 26, one to each side of the support frame 12. The relatively thin shape of the support frame 12 and the seat portion 21 allows a user (not shown in FIG. 1) easily to mount and dismount from the back of the seat portion 21, with his or her knees sliding past the buttock rest element 25 and onto the knee rest elements 26.

As can be seen from FIG. 1, each of the lever frame 11 and the support frame 12 is formed as a pair of cross-linked parallel tubular members. This facilitates the required relative spatial arrangement of the lever frame 11 and the support frame 12, as the second arm 15 of the lever frame 11 can be inserted between the parallel tubular members of the support frame base member 19. The L-shaped lever frame 11 and the V-shaped support frame 12 can thus be aligned so that their respective central junctions 16, 22 are generally co-incident.

Figure 2:
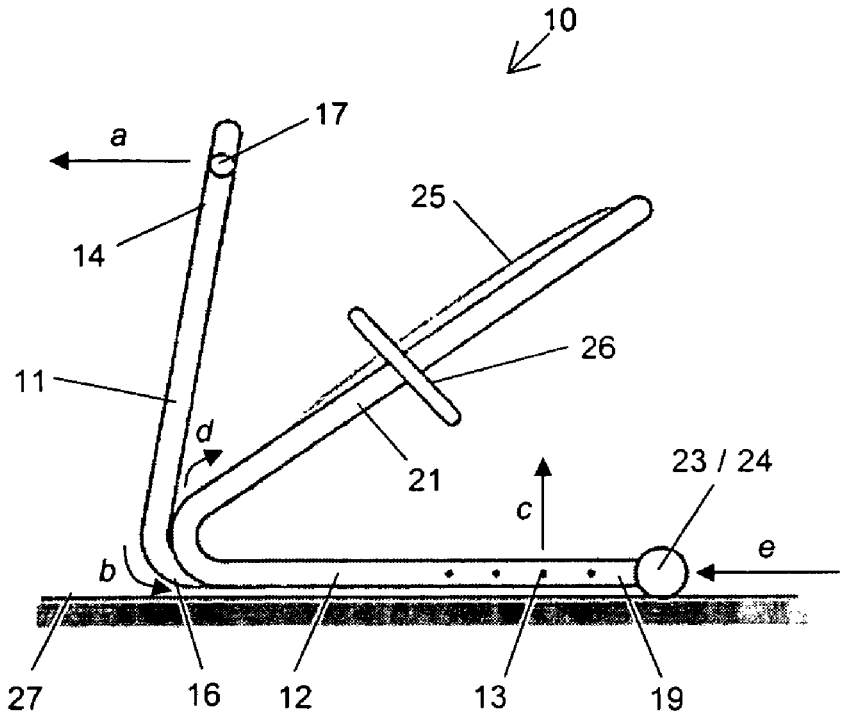
FIGS. 2 and 3 are side views of the exercise apparatus of FIG. 1, forming an illustrative sequence showing the relative positions of the lever and support frames during exercise.
Figure 3:
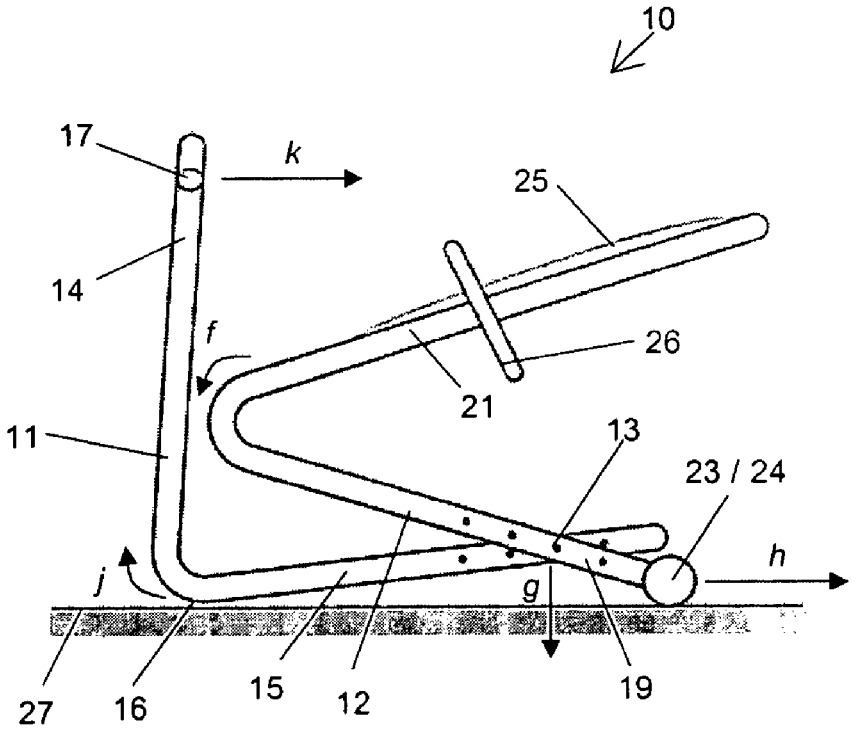

Referring now to FIGS. 2 and 3, there is shown an illustrative sequence showing the relative positions of the lever frame 11 and the support frame 12 as the exercise apparatus 10 is operated from its rest position (FIG. 2) through towards the limit of its dynamic range (FIG. 3).

Starting from the rest position as shown in FIG. 2, operation of the exercise apparatus 10 begins with a user (not shown) supported on the seat portion 21 pushing the first arm 14 away from his or her body using the handlebar 17, as indicated by arrow a. This causes the lever frame 11 to rotate in a counter-clockwise direction on its rounded central junction 16, which acts as a fulcrum by bearing against a working surface 27 beneath the exercise apparatus 10, as indicated by arrow b. The rotation of the lever frame 11 lifts the second arm 15 (not visible in FIG. 2), causing the pivot 13 to be displaced vertically upwards, as indicated by arrow c.

Due to the pivotal connection of the lever frame 11 to the support frame 12 at the pivot 13, the support frame 12 is then caused to rotate in a clockwise direction, as indicated by arrow d. The lifting and tilting motion c, d of the support frame is assisted by the translational movement of the wheeled foot 23, 24 along the working surface 27 towards the fulcrum 16, as indicated by arrow e.

The configuration achieved by the exercise apparatus 10 as it reaches the limit of its dynamic range by virtue of the motion a, b, c, d, e of the lever frame 11 and the support frame 12 is shown in FIG. 3. As can be seen, at this point in the sequence, the pivot 13 has been lifted clear of the working surface 27 by the scissor-like action of the second arm 15 of the lever frame 11 with the support frame base member 19. The seat portion 21 has been both lifted and tilted backwards closer to the horizontal, whilst the first arm 14 of the lever frame 11 is further from the seat portion 21 than in the rest position shown in FIG. 2.

From the position shown in FIG. 3, the user returns the exercise apparatus 10 to its rest position by releasing the manual force applied to the first arm 14 of the lever frame 11. As the force is released, the user's body mass urges the support frame 12 back to its rest position by rotating it in a counter-clockwise direction, as indicated by arrow f, and lowering the pivot 13 back towards the working surface 27, as indicated by arrow g. The motion f, g of the support frame 12 is assisted by the translational motion of the wheeled foot 23, 24 along the working surface 27 away from the fulcrum 16, as indicated by arrow h. As the pivot 13 is lowered g, the second arm 15 of the lever frame 11 is also lowered back towards the working surface 27, causing the lever frame 11 to rock back on its fulcrum 16 in a clockwise direction, as indicated by arrow j, which in turn brings the handlebar 17 back to its rest position, as indicated by arrow k.

The motion f, g, h, j, k of the lever frame 11 and the support frame 12 returns the exercise apparatus 10 to its rest position ready for the start of the next sequence. The sequence illustrated in FIGS. 2 and 3 will typically be repeated many times during operation of the exercise apparatus 10, in a back-and-forth rocking motion.

Figure 4:
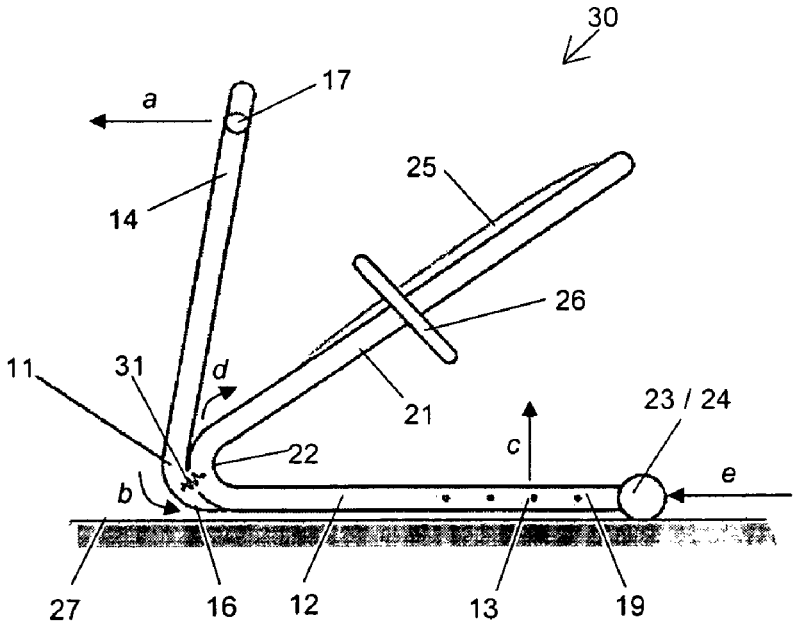
FIGS. 4 and 5 are side views of a second embodiment of exercise apparatus according to the present invention, forming an illustrative sequence showing the relative positions of the lever and support frames during exercise.
Figure 5:
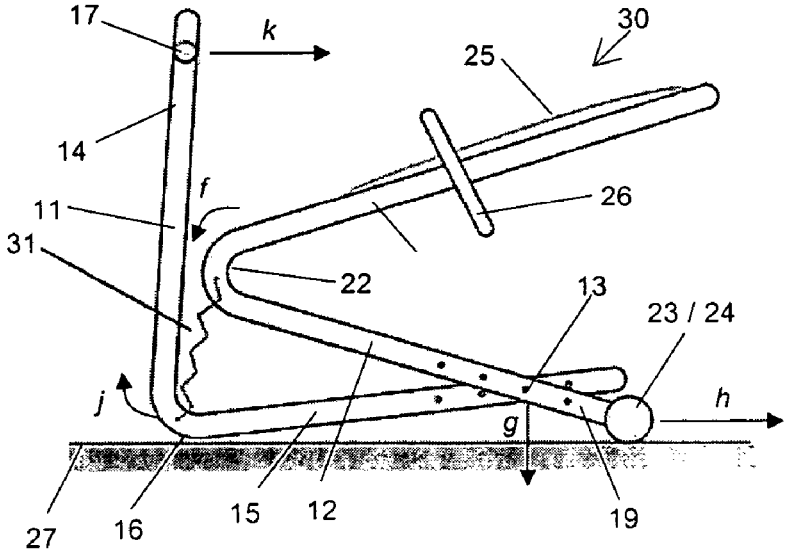

Referring now to FIGS. 4 and 5, there is shown a second embodiment of exercise apparatus, generally indicated 30, according to the present invention. The second embodiment 30 is broadly similar to the first embodiment 10 described above with reference to FIGS. 1 to 3, and where appropriate, like reference numerals have been used to indicate like components. Similarly, the motion of the lever frame 11 and the support frame 12 of the second embodiment 30 from its rest position (FIG. 4) through towards the limit of its dynamic range (FIG. 5) is identical to the sequence described above with reference to FIGS. 2 and 3.

The second embodiment 30 differs from the first embodiment 10 in that an elastic resistance element 31 links the L-shaped lever frame 11 to the V-shaped support frame 12 at the respective central junctions 16, 22 thereof.

The resistance element 31 provides a further resistive load against which the user must work, in addition to the resistive load associated with the user's own body mass. As shown in FIG. 5, the resistance element 31 must be extended in order for the support frame 12 to achieve its full dynamic range. Additionally, the resistance element 31 may be used to apply a resistive load to the sequence of returning the exercise apparatus 10 from the position shown in FIG. 5 to its rest position.

Figure 6:
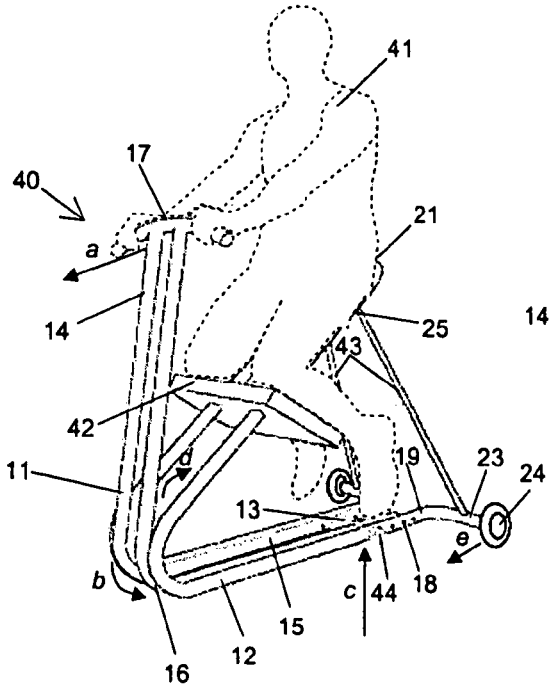
FIGS. 6 and 7 are perspective views of a third embodiment of exercise apparatus according to the present invention, forming an illustrative sequence showing the relative positions of the lever and support frames and the user during exercise.
Figure 7:
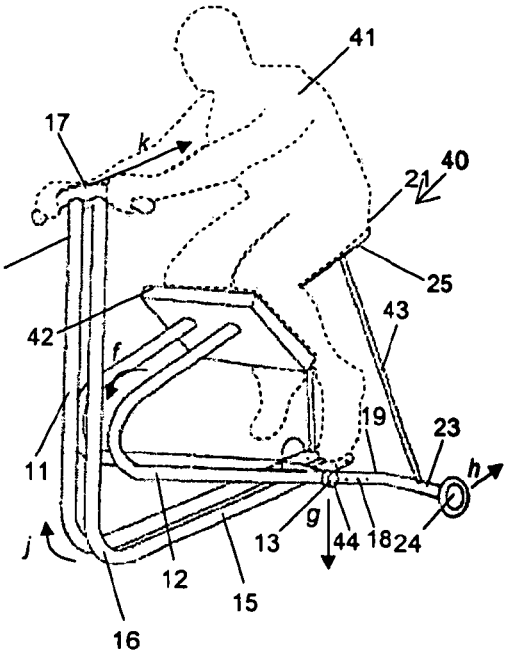

Referring now to FIGS. 6 and 7, there is shown a third embodiment of exercise apparatus, generally indicated 40, according to the present invention, in the process of supporting a user 41, for the performance of a basic abdominal muscle training exercise. Again, the third embodiment 40 is broadly similar to the first and second embodiments 10, 30 described above with reference to FIGS. 1 to 5, and where appropriate like reference numerals have been used to indicate like components. Similarly, the motion of the lever frame 11 and the support frame 12 of the third embodiment 40 from its rest position (FIG. 6) through towards the limit of its dynamic range (FIG. 7) is identical to the sequences described above with reference to FIGS. 2 to 5.

The third embodiment 40 differs from the first and second embodiments 10, 30 in that it comprises a single knee rest element 42 extending across the support frame 12 to accommodate both knees of the user 41, rather than having a separate knee rest element for each knee. The seat portion 21 is also provided with a pair of struts 43 anchored to the foot 23 of the support frame 12 to provide additional strength and rigidity to the support frame 12.

As can be seen in FIG. 6, with the exercise apparatus 40 in its rest position, the user 41 is supported via the buttock rest element 25 and the knee rest element 26 so as to assume the half-kneeling position whilst retaining a straight back, thus promoting neutral pelvic alignment. The forward motion a of the handlebar 17, coupled with the rearward tilting d and lifting c of the seat portion results in the user 41 being forced into a half-crouching position, as shown in FIG. 7. This position requires the upper and lower abdominal muscles of the user 41 to move towards one another and ensures that both sets of muscles are employed in lifting the user's body mass.

FIGS. 6 and 7 also illustrate the adjustable pivot 13 mechanism in more detail. A lockable pivot pin 44 is engaged with one of a plurality of spaced apertures 18 in the support frame base member 19, and extends therethrough to engage with one of a plurality of like spaced apertures 18 in the second arm 15 of the lever frame 11. By selecting different combinations of apertures 18 in the base member 19 and the second arm 15 respectively, the location of the pivot 13 can be adjusted, so as to provide adjustable resistance for the user 41 to exercise against, whilst still working against his or her own body mass. The pivot 13 position can also be adjusted in order to accommodate users 41 of differing sizes.

Figure 8:
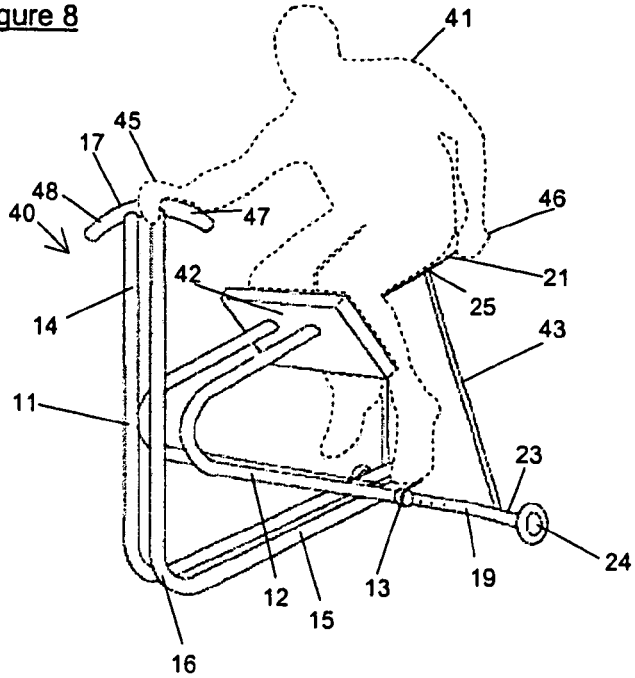
FIG. 8 is a perspective view of the exercise apparatus of FIGS. 6 and 7, showing the user performing an alternative abdominal muscle training exercise.

Referring now to FIG. 8, this shows the third embodiment of exercise apparatus 40 being utilised for the performance of an alternative abdominal muscle training exercise, the apparatus 40 being shown in a position towards the limit of its dynamic range, as in FIG. 7. To perform the exercise, the user 41 utilises his or her right hand 45 only, with the left hand 46 remaining free of the apparatus 40. With the right hand 45, the user 41 holds the handlebar 17 towards its left end 47 (from the user's perspective). Operating the apparatus 40 in this position subjects the user's right side abdominal muscles to both a forward contraction and a rotational contraction simultaneously. Repeating the exercise with the user's left hand 46 holding the handlebar towards its right end 48 (from the user's perspective) provides the same exercise for the user's left side abdominal muscles.

Figure 9:
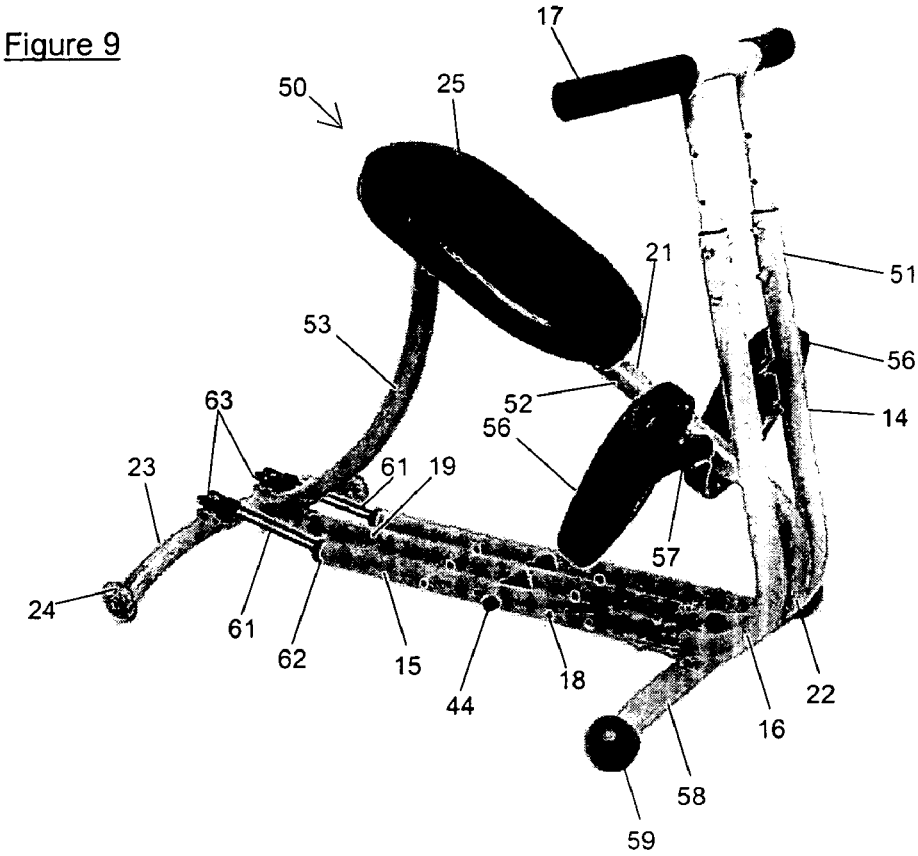
FIG. 9 is a perspective side view of a fourth embodiment of exercise apparatus according to the present invention.
Figure 10:
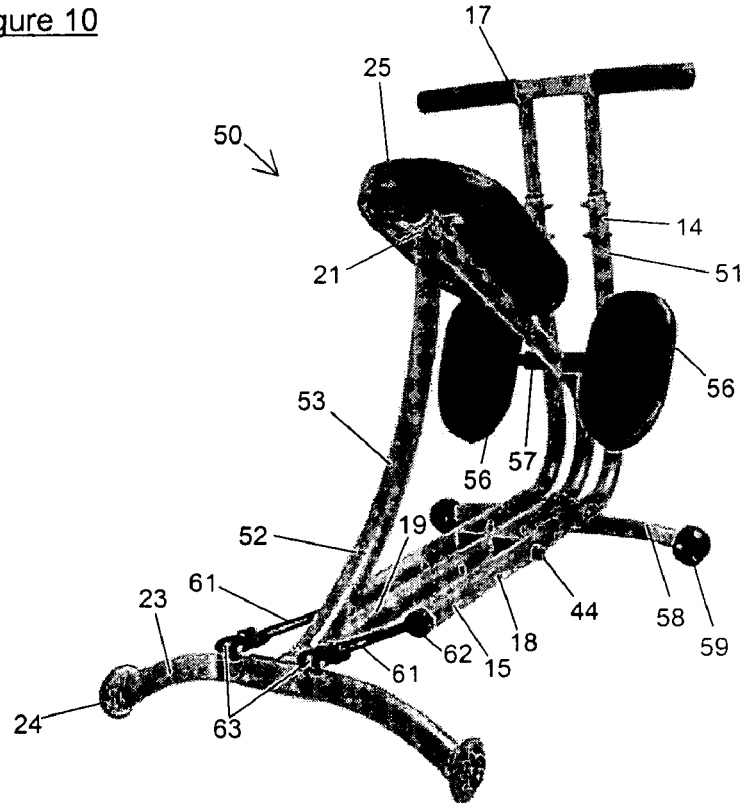
FIG. 10 is a perspective rear view of the exercise apparatus of FIG. 9.

Referring now to FIGS. 9 and 10, there is shown a fourth embodiment of exercise apparatus, generally indicated 50, according to the present invention. As above, like reference numerals are utilised where components of the fourth embodiment 50 do not differ significantly from the corresponding components of the first, second and third embodiments 10, 30, 40. The fourth embodiment 50 differs from the first, second and third embodiments 10, 30, 40 in four key respects, as will now be described.

Firstly, the support frame 52 is formed with a single tubular construction, rather than the parallel tubular construction of the support frame 12 in earlier described embodiments. This enables the support frame 52 to slot in between the parallel tubular members of the lever frame 51, facilitating the interaction of the two frames 51, 52. As can also be seen from FIGS. 9 and 10, a single strut 53 interconnects the base member 19 and the seat portion 21 of the support frame 52, said single strut 53 being rather more study than the struts 43 of the third embodiment 40.

Secondly, the knee rest elements 56 are again split into separate units, one provided either side of the support frame 52. However, the knee rest elements 56 differ from those of the previous embodiment in that they are each connected to the support frame 52 via a flexible mounting element 57. The flexible mounting elements 57 permit minimal movement of each knee rest element 56 relative to the support frame 52, so as to accommodate movement during exercise without causing undue stress to the knees of the user 41.

Thirdly, the lever frame 51 is constructed such that its central junction 16 does not bear directly on the working surface 27 beneath the exercise apparatus 50, but instead acts on the surface 27 via an intermediary member in the form of a rocker bar 58 having a foot 59, at either end thereof. The rocker bar 58 displaces the forces imparted by the user 41 during exercise out to the sides of the apparatus 50 thus enhancing stability, whilst the rocker bar feet 59 facilitate the rocking motion of the apparatus 50 during exercise.

Figure 11:
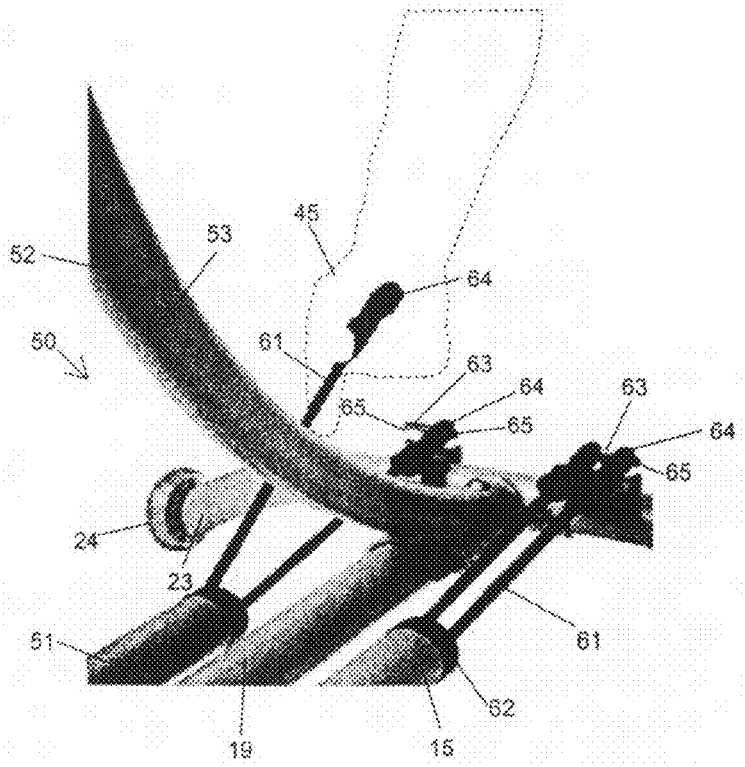
FIG. 11 is a detailed view of a feature of the exercise apparatus of FIGS. 9 and 10.

Fourthly, the exercise apparatus 50 is provided with elastic resistance elements 61 interconnecting the free end 62 of the lever frame 51 with fixing points 63 provided on the foot end 23 of the support frame 52, as will now be discussed in more detail with reference to FIG. 11.

The elastic resistance elements 61 extend from the free ends 62 of the lever frame 51, and may be recoiled within the parallel tubular members constituting the second arm 15, when the user 41 wishes to exercise without added resistance. When it is desired to exercise against additional resistance, the user 41 simply pulls the elastic resistance elements 61 out of the free ends 62 of the lever frame 51 with his or her hand 45. As can be seen from FIG. 11, each elastic resistance element 61 terminates in a loop 64, which is adapted to engage with a complementary hook 65 provided on the fixing points 63.

Figure 12:
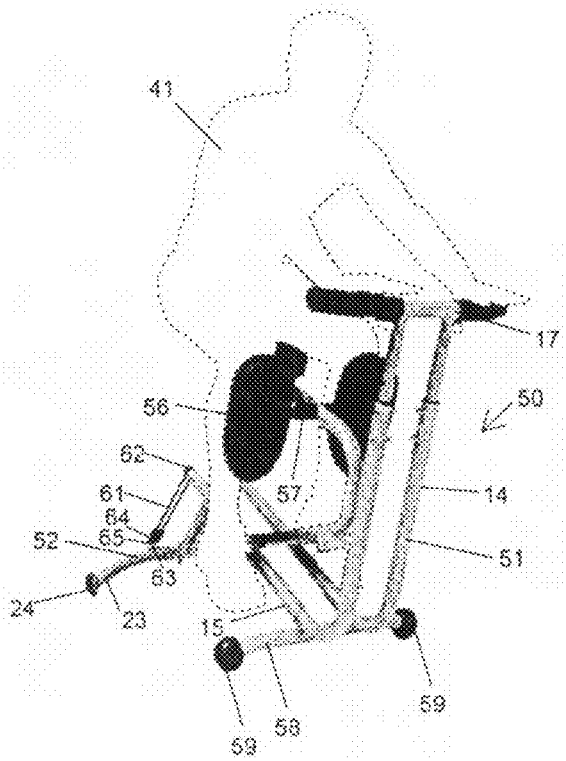
FIG. 12 is a perspective view of the exercise apparatus of FIGS. 9 to 11, showing a user performing an abdominal muscle training exercise.

Referring now to FIG. 12, this shows a user 41 exercising on abdominal muscle training apparatus according to a fourth embodiment 50 of the present invention, utilising the elastic resistance elements 61. As can be seen, the user 41 exercises by pushing the handlebar 17 away from his or her body, causing the lever frame 51 to rotate, and the support frame 52 to rotate and lift. As this motion occurs, the foot wheels 24 of the support frame 52 move towards the rocker feet 59 of the lever frame 51, whilst the free end 62 of the lever frame 62 is simultaneously lifted away from the working surface 27. This increases the distance between the free ends 62 and the fixing points 63, thus tensing the elastic resistance elements 61, and providing an additional resistive force for the user 41 to exercise against.

The invention claimed is:

1. Exercise apparatus comprising:

a support frame including a pair of cross linked parallel tubular members and having a base member;

a seat portion associated with said base member, said seat portion comprising a buttock support element and a knee rest element and being thereby adapted to support a user in a half-kneeling position; and a lever frame including a pair of cross linked parallel tubular members and having a first arm portion having a handlebar proximate one end and adapted for manual operation by said user, and a second arm portion arranged generally perpendicular to said first arm thereby to form a generally L-shaped lever frame, said second arm terminating at a flee end and being linked to the base member via a pivot; said second arm inserted between said parallel tubular members of said support frame base, and wherein said first and second arms are joined at a rounded junction at or adjacent a fulcrum for the lever flame, such that counterclockwise rotation of the lever frame about the fulcrum causes clockwise rotation of the support frame about the pivot, and vice versa;

and wherein said junction is arranged to bear directly or indirectly against a working surface beneath the exercise apparatus; whereby in use, the exercise apparatus is operable by said user manually pushing repeating a cycle of applying manual force to said first arm so as to push said first arm away from said user's body, and subsequently releasing said applied force thereby to rotate the lever frame about said fulcrum, thus lifting said second arm, which in turn causes the seat portion associated with the base member to lift and tilt, the user's abdominal muscles thereby being exercised in lifting the user's own body mass.

2. Exercise apparatus as claimed in claim 1, wherein the junction forms a fulcrum for the lever frame and is arranged to bear directly against the working surface.

3. Exercise apparatus as claimed in claim 1, wherein the junction is arranged to bear indirectly against the working surface via an intermediary member forming a fulcrum for the lever frame.

4. Exercise apparatus as claimed in claim 3, wherein the intermediary member is a rocker bar having rounded feet at either end thereof.

5. Exercise apparatus as claimed in claim 1, wherein the base member extends from the pivot to a foot adapted to bear against a working surface beneath the exercise apparatus, said foot being adapted for translational movement along said working surface.

6. Exercise apparatus as claimed in claim 5, wherein the foot is provided with a rotational member to facilitate said translational movement.

7. Exercise apparatus as claimed in claim 5, wherein the base member extends beyond the pivot, distal from the foot.

8. Exercise apparatus as claimed in claim 7, wherein the seat portion is joined to the base member at a connection point located distal from the foot, such that the pivot is located between said foot and said connection point.

9. Exercise apparatus as claimed in claim 8, wherein the seat portion is joined to the base member at an acutely angled junction, thereby forming a generally V-shaped support frame.

10. Exercise apparatus as claimed in claim 9, wherein the generally L-shaped lever frame and the generally V-shaped support frame are arranged such that the respective junctions of said frames are generally co-incident when the apparatus is at rest.

11. Exercise apparatus as claimed in claim 10, wherein the respective junctions of the generally L-shaped lever frame and the generally V-shaped support frame are linked by at least one elastic resistance element.

12. Exercise apparatus as claimed in claim 5, wherein the free end of the lever frame and the foot of the support frame are linked by at least one elastic resistance element.

13. Exercise apparatus as claimed in claim 12, wherein the foot of the support frame is provided with at least one fixing point adapted to receive said elastic resistance element, and wherein said elastic resistance element is provided with complementary engagement means adapted to connect to said fixing point.

14. Exercise apparatus as claimed in claim 12, wherein the lever frame is formed with a hollow, tubular construction, and wherein said at least one elastic resistance element is adapted to extend from the free end of the lever frame when in use, but to be recoiled therewithin for storage when not in use.

15. Exercise apparatus as claimed in claim 1, wherein the pivot comprises a lockable pin engageable with a complementary aperture formed in each of the second arm of the lever frame and the base member of the support frame, and wherein each of the second arm of the lever frame and the base member of the support frame comprise a plurality of spaced like apertures, to enable the location of the pivot to be adjusted.

16. Exercise apparatus as claimed in claim 1, wherein the seat portion comprises a buttock support element and two separate knee rest elements, each being mounted independently of the other via a flexible mounting element adapted to permit minimal movement of each knee rest element relative to the support frame.

17. Exercise apparatus as claimed in claim 1, wherein the first arm comprises a handlebar to facilitate manual operation by the user.

* * * * *